US007698773B2

(12) United States Patent
Sotelo

(10) Patent No.: US 7,698,773 B2
(45) Date of Patent: Apr. 20, 2010

(54) HOLDER FOR HYGIENIC WIPES AND THE LIKE

(76) Inventor: Helen Sotelo, 821 S. Holly Pl., West Covina, CA (US) 91790

( * ) Notice: Subject to any disclaimer, the term of this patent is extended or adjusted under 35 U.S.C. 154(b) by 0 days.

(21) Appl. No.: 12/228,751

(22) Filed: Aug. 14, 2008

(65) Prior Publication Data

US 2009/0044363 A1 Feb. 19, 2009

Related U.S. Application Data

(60) Provisional application No. 60/964,593, filed on Aug. 14, 2007.

(51) Int. Cl.
*A47K 7/08* (2006.01)

(52) U.S. Cl. ..... 15/210.1; 15/144.1; 15/231

(58) Field of Classification Search ..... 15/210.1, 15/231, 244.1, 144.1
See application file for complete search history.

(56) References Cited

U.S. PATENT DOCUMENTS 1,585,269 A * 5/1926 Serva ..... 15/231
1,859,747 A * 5/1932 Neale ..... 15/219
1,872,589 A * 8/1932 Hoff ..... 15/244.1
3,090,985 A * 5/1963 Baum ..... 15/244.1
5,044,040 A * 9/1991 Tetrault ..... 15/210.1
5,293,662 A * 3/1994 Newman et al. ..... 15/210.1
5,809,604 A * 9/1998 Olstyn ..... 15/111
2003/0229958 A1* 12/2003 Thompson et al. ..... 15/104.002
2004/0088813 A1* 5/2004 Cox ..... 15/210.1
2004/0237239 A1* 12/2004 Savell ..... 15/210.1
2005/0000047 A1* 1/2005 Kelly et al. ..... 15/104.94
2008/0028557 A1* 2/2008 Klaes ..... 15/143.1

FOREIGN PATENT DOCUMENTS

JP 2007-167092 * 7/2007

* cited by examiner

*Primary Examiner*—Randall Chin
(74) *Attorney, Agent, or Firm*—Raymond Y. Chan; David and Raymond Patent Firm

(57) ABSTRACT

A holder for hygienic wipes and the like includes triangular-shaped a base member that is suitable sized and shaped for securing a wiping sheet thereto. An adjustable handle is removably attached to the base member. The base member is also configured as a wedge for allowing a user to comfortably position the apparatus between the buttocks. Gripping members are positioned on the base member bottom surface on either side thereof for securing the wiping sheet to the top surface of the base member. Each gripping member includes raised teeth for securing the wipe in place. The handle is substantially cylindrically-shaped and is telescopically extendable, allowing the apparatus to be used by larger individuals. The handle is hingedly connected to the base member, enabling the user to angle the base member for optimal contact and comfort.

16 Claims, 7 Drawing Sheets

HOLDER FOR HYGIENIC WIPES AND THE LIKE

CROSS REFERENCE TO RELATED APPLICATION

This application is a non-provisional application of a provisional application having an application No. 60/964,593 and a filing date of Aug. 14, 2007.

BACKGROUND OF THE PRESENT INVENTION

1. Field of Invention

This invention relates to holder apparatuses and, more particularly, to a holder for hygienic wipes and the like for providing caregivers with a more sanitary means of caring for infants and other dependent persons.

2. Description of Related Arts

Rolled toilet paper has found generally universal acceptance in the civilized world for the usual hygienic purposes. On occasion, various public facilities have instead employed separate sheets of paper. In any event, the use of such wiping material generally involves placing together several layers of the particular material. The individual then places the multi-layered wad of paper in contact with the portion of the anatomy requiring cleansing. The movement of the paper in a generally linear direction hopefully effects removal of most of the undesired detriments to cleanliness. The paper itself, of course, provides the sole barricade between such contaminants and the individual's hand and fingers. The above procedure, though universally used, suffers from a plethora of undesirable and disturbing shortcomings. Yet, it continues to plague the mass of civilized humanity committed to its use.

Much of the paper used during the hygiene procedures does not actually cleanse the desired area. Most of it serves a different purpose, if any at all. For example, a portion of the paper simply allows the hand to hold it. Much of the paper attempts to shield the rest of the hand, although not involved in housing the paper, from the filth involved. A good portion of the paper has no use, but rather results from the requirements or desire to place it in the cylindrical roll form. Moreover, a part of the paper employed simply provides some assurance to the user of sufficient layers to prevent its breaking at an undesirable moment. The use of an amount of material vastly in excess of that required becomes even more burdensome in these days of shortages of paper fiber. Nonetheless, the waste of a large fraction of the paper made into this form continues.

Even with an abundance of the paper material, the many layers can, on occasion, saturate with moisture and rupture. This allows contaminants to attack the hand and the surrounding clothing of the individual involved. Even without tearing, some contaminants can escape around the side of the paper to dirty the individual's hands and clothing. The problems alluded to above represent, at best, a major inconvenience for a person cleaning himself. For an individual attending to another, such as an infant or an invalid, the undesirable aspects of the situation become intolerable.

Accordingly, a need remains for a holder hygienic wipes and the like in order to overcome the above-noted shortcomings. The present invention satisfies such a need by providing an apparatus that is convenient and easy to use, is durable yet lightweight in design, is versatile in its applications, and enables users to easily cleanse hard to reach areas of the body, in a simple and comfortable manner. In particular, the present invention greatly appeals to users who, because of size or physical limitations experience difficulty in comfortably reaching and cleansing their body. By enabling those who are recovering from surgery, suffer limit mobility, are pregnant or obese to effortlessly care for themselves, the apparatus proves a practical assist in maintaining independence and self reliance during a difficult period.

SUMMARY OF THE PRESENT INVENTION

The novel features believed to be characteristic of this invention are set forth with particularly in the appended claims. The invention itself, however, both as to its organization method of operation, together with further objects and advantages thereof, may best be understood by reference to the following description taken in connection with the accompanying drawings in which:

The figure generally includes various perspective views showing a holder for hygienic wipes and the like, in accordance with the present invention.

These and other objectives, features, and advantages of the present invention will become apparent from the following detailed description, the accompanying drawings, and the appended claims.

DETAILED DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The apparatus of this invention is referred to generally in the figures and is intended to provide a holder for hygienic wipes and the like. It should be understood that the apparatus may be used to hold many different types of wiping sheets and should not be limited in use only holding conventional baby wipes.

Figure 1:
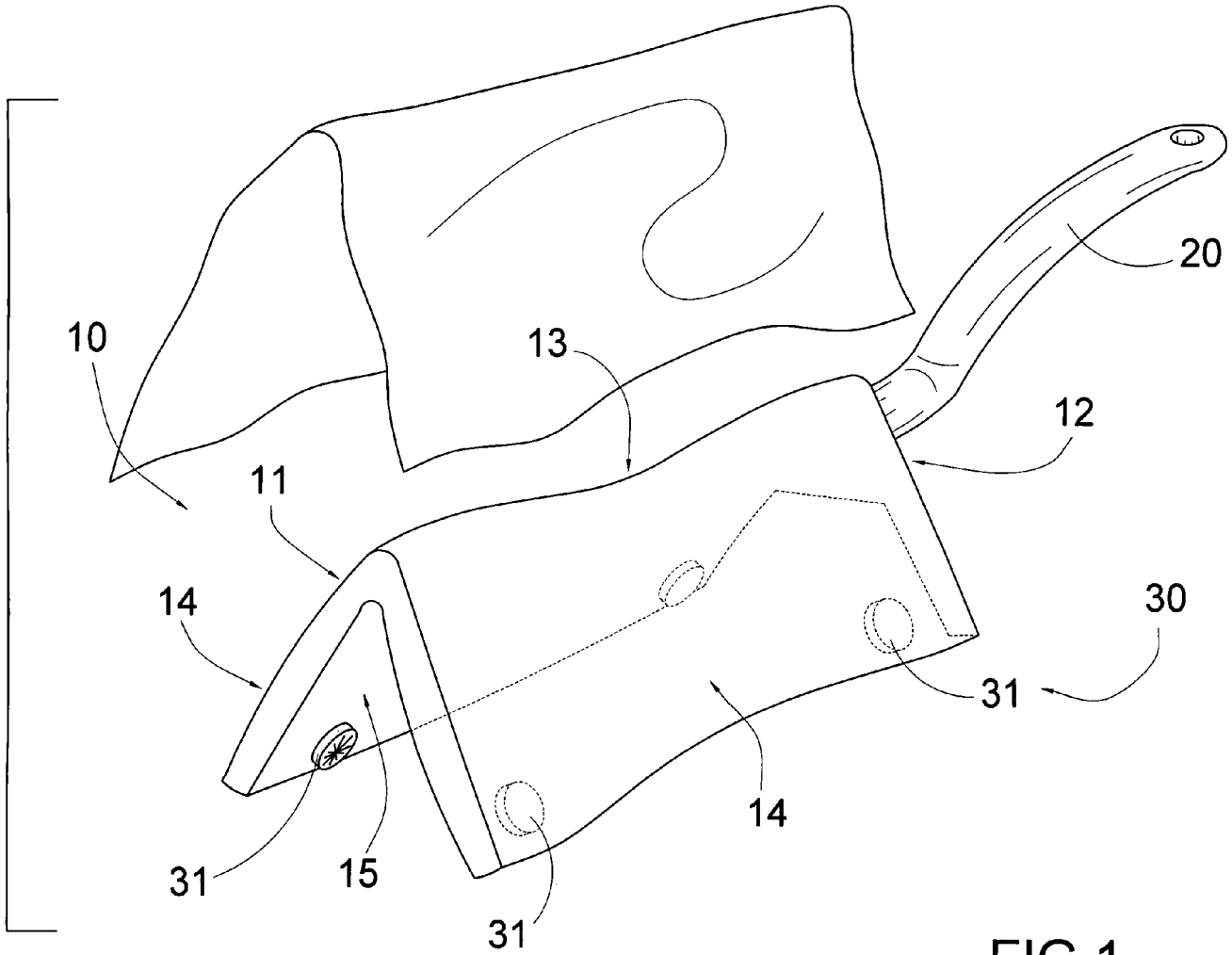
FIG. 1 is a perspective view of a holder for hygienic wipes and the like according to a preferred embodiment of the present invention.

Referring to the figures in general, the apparatus includes a base member 10 that is produced of heavy duty plastic material and is suitably sized and shaped for securing a baby wipe or flushable moist tissue thereto. As shown in FIG. 1, the base member 10 has a front wall 11, a rear wall 12, a top ridge 13 extended from the front wall 11 to the rear wall 12, and two slanted top surfaces 14 inclinedly and sidewardly extending along the top ridge 13 for the wiping sheet placing on the top surfaces 14.

Such a base member 10 is substantially triangular-shaped and measures approximately 5" in total length, and is of suitable width to accommodate a standard baby wipe. Of course, the base member 10 may be produced in a variety of dimensions for accommodating various types of wiping sheets, as is obvious to a person of ordinary skill in the art. The base member 10 is also configured as a wedge, which is vital for allowing a user to comfortably position the apparatus between the buttocks, thus enabling the user to gently and easily wipe away urine or feces. In other words, the base member 10 has an inverse "V" cross section to configure as a wedge for allowing the user to comfortably position the base member 10 between the buttocks. Of course, the apparatus may also be used as an ointment applicator, as is obvious to a person of ordinary skill in the art.

Figure 2:
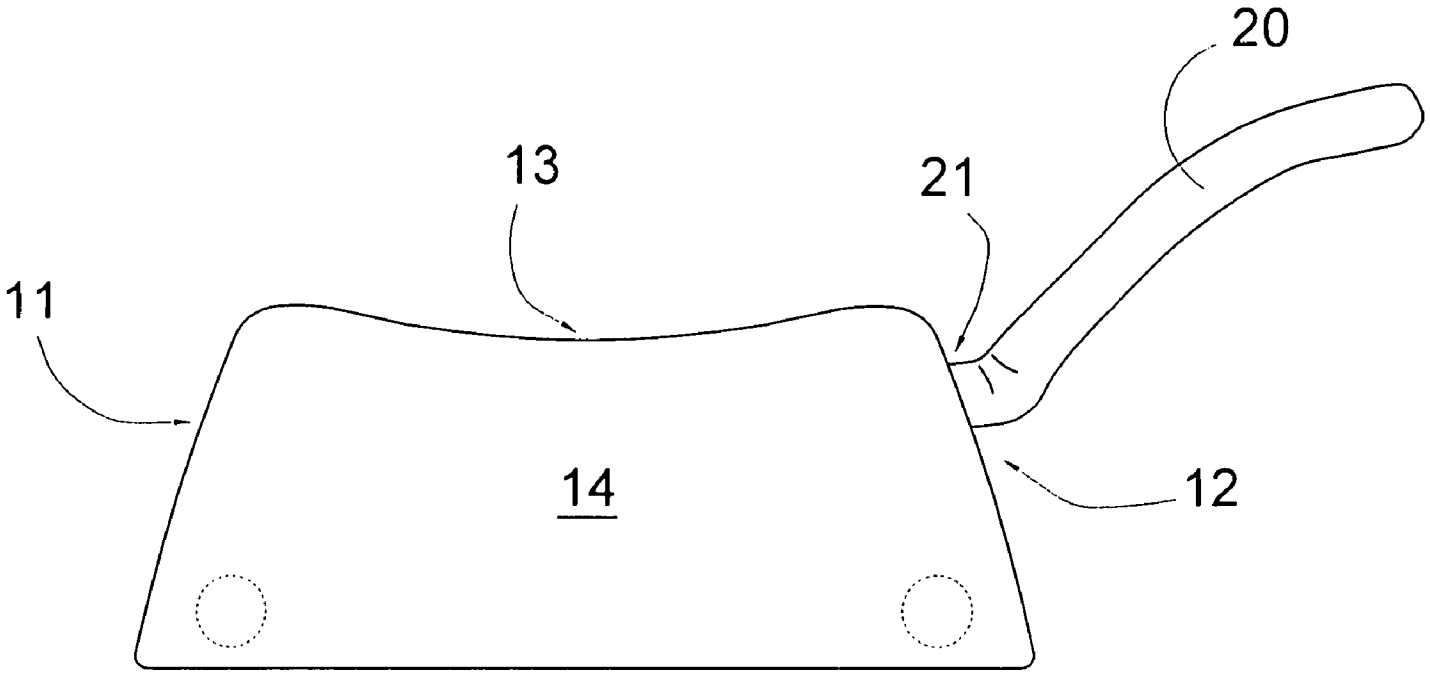
FIG. 2 is a side view of the holder according to the above preferred embodiment of the present invention.
Figure 3:
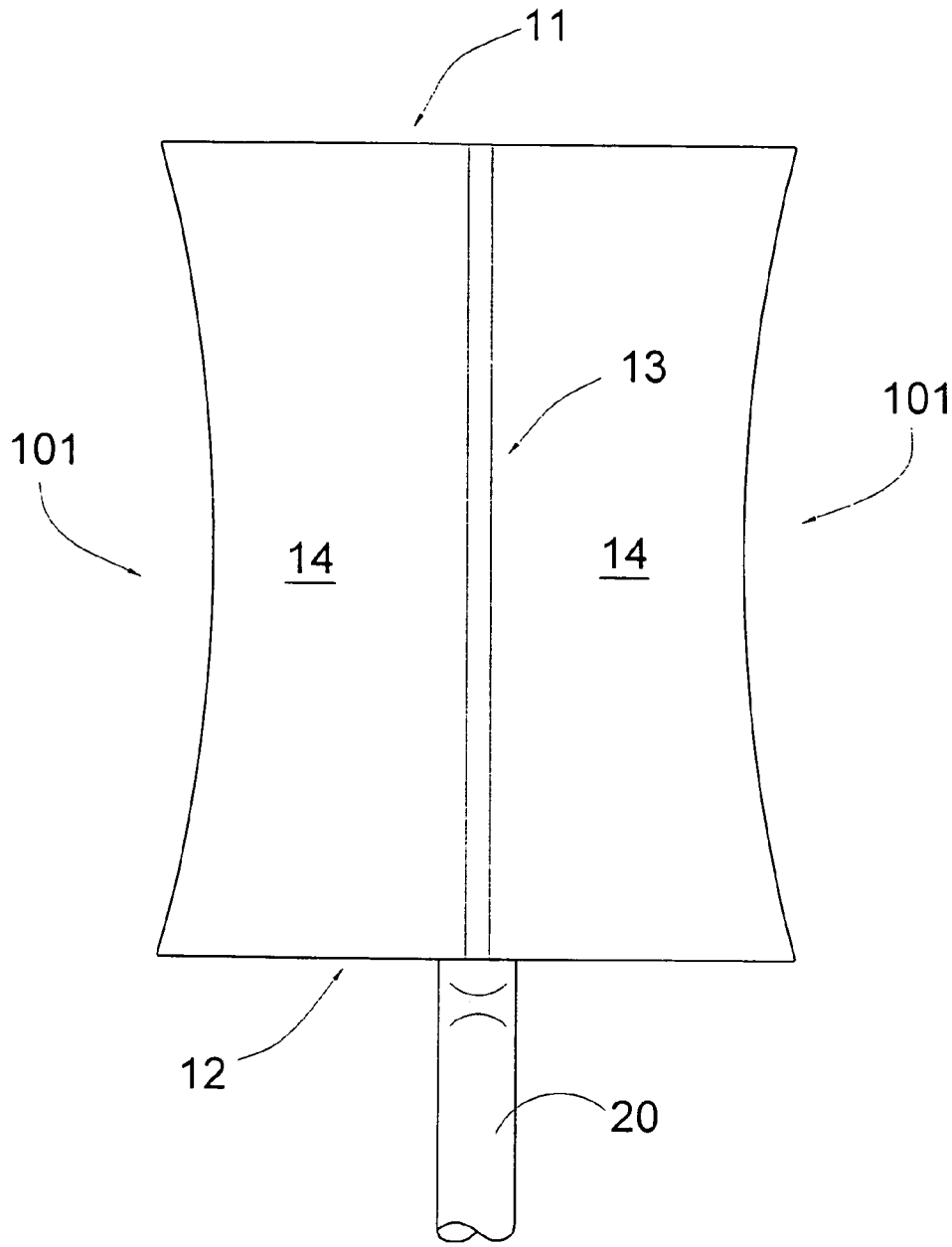
FIG. 3 is a top view of the holder according to the above preferred embodiment of the present invention.

In addition, the top ridge 13 is a curved ridge that a height of the top ridge 13 is gradually increasing from a mid-portion towards the front and rear walls 11, 12, as shown in FIG. 2. Therefore, the top ridge 13 has a predetermined curvature for reaching the buttocks to gently and easily wipe away urine or feces. As shown in FIG. 3, the base member 10 also has a slimming mid-portion 101 that a width of the base member 10 is gradually increasing from the slimming mid-portion 101 towards the front end rear walls 11, 12, such that the slimming mid-portion 101 of the base member 10 can be easily positioned between the buttocks. In other words, the top surfaces 14 of the base member 10 are curving inwardly at the slimming mid-portion 101 thereof.

The holder of the present invention further comprises an elongated handle 20 rearwardly and inclinedly extended from the rear wall 12 of the base member 10 at a direction aligning with the top ridge 13 for the user to position the base member 10 between the buttocks of the user. Accordingly, the handle 20 is an adjustable handle is removably attached to the base member 10 via a hinge 40.

The handle 20 is substantially cylindrically-shaped and measures an ample 9" in total length. The handle 20 is telescopically extendable, which is vital for allowing the apparatus to be used by larger individuals. The handle 20 is also hingedly connected to the base member 10 via the hinge 40, which is critical for enabling the user to angle the base member 10 for optimal contact and comfort.

The holder of the present invention further comprises a securing unit 30 provided at the base member 10 for securing the wiping sheet on the top surfaces 14 of the base member 10. Accordingly, the securing unit 30 comprises a plurality of gripping members are positioned on the bottom surface 15 of the base member 10 on either side thereof, which is important for securing the wiping sheet to the top surfaces 14 of the base member 10. Each gripping member includes a plurality of raised teeth 31A, or a simple sliding clasp fastener 31 for use in securing the wipe in place.

Figure 4A:
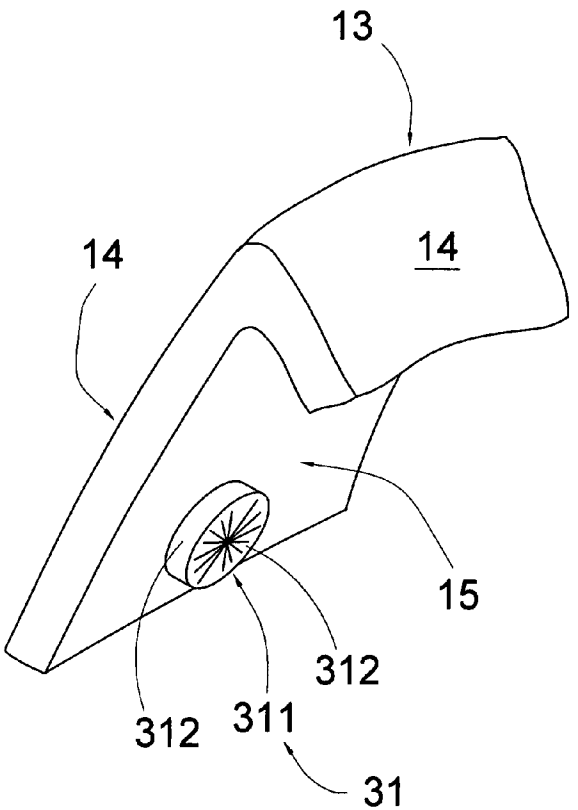
FIG. 4A and FIG. 4B illustrate the securing unit and its alternative of the holder according to the above preferred embodiment of the present invention.
Figure 4B:
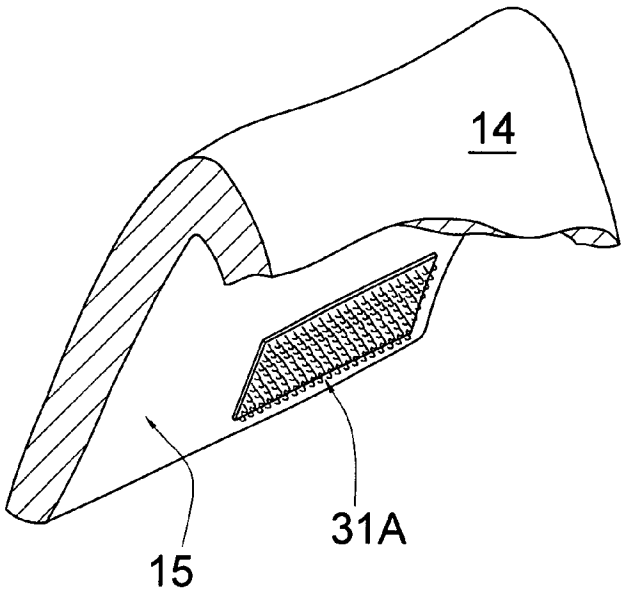

As shown in FIG. 4, each of the clasp fasteners 31 has a clasping cavity 311 and a plurality of flexible flaps 312 radially extended towards a center of the clasping cavity 311. In order to secure the wiping sheet on the top surfaces 14 of the base member 10, the user is able to place the wiping sheet on top of the top surfaces 14 of the base member 10 such that the two side edge portions of the wiping sheet are adapted to be overlappedly folded at the bottom surface 15 of the base member 10. Then, the user is able to push the edge portion of the wiping sheet into the clasping cavity 311 until the edge portion of the wiping sheet is held by the flexible flaps 312.

Alternatively, the raised teeth 31A are protruded from the bottom surface 15 of the base member 10 to engage with the edge portion of the wiping sheet when the edge portion of the wiping sheet is overlappedly folded at the bottom surface 15 of the base member 10.

Figure 5:
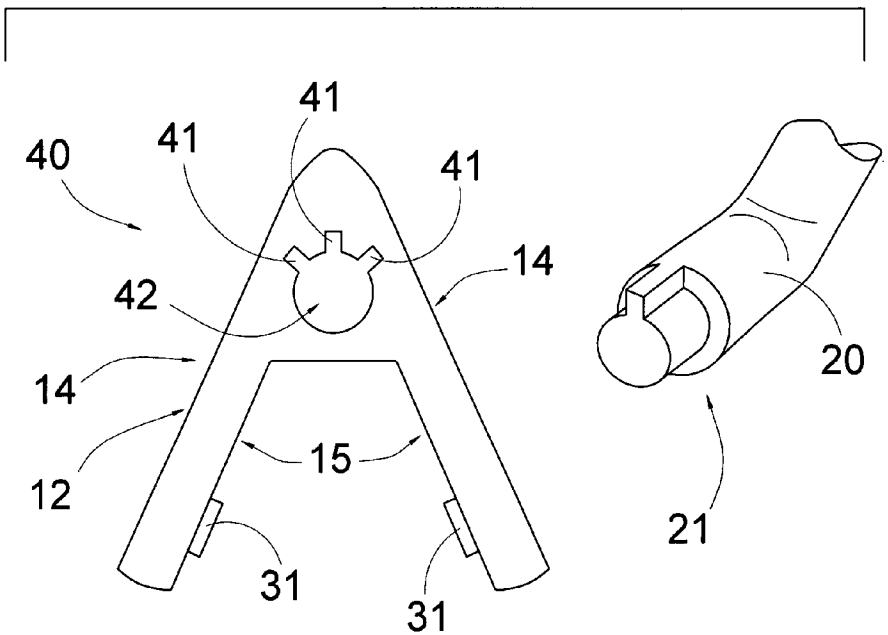
FIG. 5 illustrates the hinge of the holder according to the above preferred embodiment of the present invention.

As shown in FIG. 5, the hinge 40 is arranged for detachably attaching the handle 20 to the rear wall 12 of the base member 10, wherein the hinge 40 contains a plurality of engaging slots 41 which are provided at the rear end of the base member 10 and are formed at different orientations, such that a coupling end 21 of the handle 20 is engaged with one of the engaging slots 41 for enabling the user to angle the base member 10 for optimal contact and comfort.

It is worth mentioning that the coupling end 21 of the handle 20 has a non-circular cross section matching with the engaging slot 41 having a non-circular cross section in such a manner that when the coupling end 21 of the handle 20 is slidably inserted into one of the engaging slots 41, the coupling end 21 of the handle 20 is interlocked with the base member 10 for preventing an unwanted rotational movement of the base member 10 with respect to the handle 20.

In particular, the hinge 40 further contains an enlarged slot portion 42 formed at the rear wall 12 of the base member 10, as shown in FIG. 5, wherein one of the engaging slots 41 is vertically, radially, and upwardly extended from the slot portion 42 while two of the engaging slots 41 are inclinedly, radially and upwardly extended from the slot portion 42, such that when the coupling end 21 of the handle 20 is coupled at the slot portion 42 with one of the engaging slots 41, the base member 10 is retained at a predetermined orientation. It is worth mentioning that both right-handed and left-handed users are able to operate the holder of the present invention by selectively inserting the coupling end 21 of the handle 20 into one of the engaging slots 41.

Figure 6:
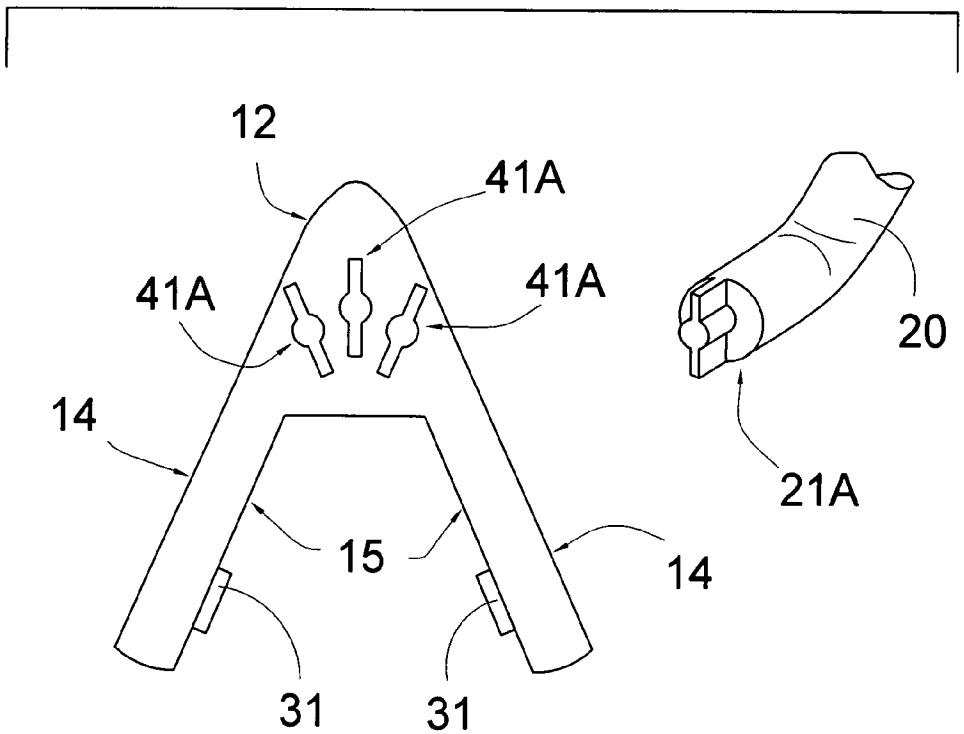
FIG. 6 illustrates an alternative mode of the hinge of the holder according to the above preferred embodiment of the present invention.

Alternatively, the engaging slots 41A are individual slots spacedly formed at the rear wall 12 of the base member 10 such that the user is able to adjust the orientation of the base member 10 by selectively inserting the coupling end 21A of the handle 20 into one of the engaging slots 41. Accordingly, each of the engaging slots 41A has a circular portion and two elongated shank portions outwardly and radially extended from the circular portion. Likewise, the coupling end 21A of the handle 20 also has a corresponding circular portion and two shanks for fitting into the engaging slot 41A, as shown in FIG. 6.

There has thus been outlined, rather broadly, the more important features of the invention in order that the detailed description thereof that follows may be better understood, and in order that the present contribution to the art may be better appreciated. The are addition features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are no familiar with paten or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may includes variation in size, materials, shape, form, function and manner of operation. The assembly and use of the present invention are deemed readily apparent and obvious to one skilled in the art.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A holder for holding a wiping sheet, comprising:

a base member having a front wall, a rear wall, a top ridge extended from said front wall to said rear wall, and two slanted top surfaces inclinedly and sidewardly extending along said top ridge for the wiping sheet placing on said top surfaces, wherein said top ridge is a curved ridge that a height of said top ridge is gradually increasing from a mid-portion towards said front and rear walls;

a securing unit provided at said base member for securing the wiping sheet on said top surfaces of said base member; and an elongated handle rearwardly and inclinedly extended from said rear wall of said base member at a direction aligning with said top ridge for a user to position said base member between the buttocks of said user.

2. A holder for holding a wiping sheet, comprising:

a base member having a front wall, a rear wall, a top ridge extended from said front wall to said rear wall, and two slanted top surfaces inclinedly and sidewardly extending along said top ridge for the wiping sheet placing on said top surfaces, wherein said top ridge is a curved ridge that a height of said top ridge is gradually increasing from a mid-portion towards said front and rear walls, and said base member has an inverse "V" cross section to configure as a wedge for allowing said user to comfortably position said base member between buttocks;

a securing unit provided at said base member for securing the wiping sheet on said top surfaces of said base member; and an elongated handle rearwardly and inclinedly extended from said rear wall of said base member at a direction aligning with said top ridge for a user to position said base member between the buttocks of said user.

3. The holder, as recited in claim 2, wherein said base member has a slimming mid-portion that a width of said base member is gradually increasing from said slimming mid-portion towards said front end rear walls.

4. The holder, as recited in claim 3, wherein said securing unit comprises a plurality of clasp fasteners spacedly provided at a bottom surface of said base member for holding edge portions of the wiping sheet so as to retain the wiping sheet on said top surfaces of said base member.

5. The holder, as recited in claim 4, further comprising a hinge for detachably attaching said handle to said rear wall of said base member, wherein said hinge contains a plurality of engaging slots which are provided at said rear end of said base member and are formed at different orientations, such that a coupling end of said handle is engaged with one of said engaging slots for enabling said user to angle said base member for optimal contact and comfort.

6. The holder, as recited in claim 5, wherein said hinge contains an enlarged slot portion formed at said rear wall of said base member, wherein one of said engaging slots is vertically, radially, and upwardly extended from said slot portion while two of said engaging slots are inclinedly, radially and upwardly extended from said slot portion, such that when said coupling end of said handle is coupled at said slot portion with one of said engaging slots, said base member is retained at a predetermined orientation.

7. The holder, as recited in claim 6, wherein said coupling end of said handle has a non-circular cross section matching with said engaging slot having a non-circular cross section in such a manner that when said coupling end of said handle is slidably inserted into one of said engaging slots, said coupling end of said handle is interlocked with said base member for preventing an unwanted rotational movement of said base member with respect to said handle.

8. The holder, as recited in claim 2, wherein said securing unit comprises a plurality of clasp fasteners spacedly provided at a bottom surface of said base member for holding edge portions of the wiping sheet so as to retain the wiping sheet on said top surfaces of said base member.

9. The holder, as recited in claim 2, wherein said securing unit comprises a plurality of raised teeth spacedly provided at a bottom surface of said base member for holding edge portions of the wiping sheet so as to retain the wiping sheet on said top surfaces of said base member.

10. The holder, as recited in claim 3, wherein said securing unit comprises a plurality of raised teeth spacedly provided at a bottom surface of said base member for holding edge portions of the wiping sheet so as to retain the wiping sheet on said top surfaces of said base member.

11. The holder, as recited in claim 10, further comprising a hinge for detachably attaching said handle to said rear wall of said base member, wherein said hinge contains a plurality of engaging slots which are provided at said rear end of said base member and are formed at different orientations, such that a coupling end of said handle is engaged with one of said engaging slots for enabling said user to angle said base member for optimal contact and comfort.

12. The holder, as recited in claim 11, wherein said hinge contains an enlarged slot portion formed at said rear wall of said base member, wherein one of said engaging slots is vertically, radially, and upwardly extended from said slot portion while two of said engaging slots are inclinedly, radially and upwardly extended from said slot portion, such that when said coupling end of said handle is coupled at said slot portion with one of said engaging slots, said base member is retained at a predetermined orientation.

13. The holder, as recited in claim 12, wherein said coupling end of said handle has a non-circular cross section matching with said engaging slot having a non-circular cross section in such a manner that when said coupling end of said handle is slidably inserted into one of said engaging slots, said coupling end of said handle is interlocked with said base member for preventing an unwanted rotational movement of said base member with respect to said handle.

14. A holder for holding a wiping sheet, comprising:

a base member having a front wall, a rear wall, a top ridge extended from said front wall to said rear wall, and two slanted top surfaces inclinedly and sidewardly extending along said top ridge for the wiping sheet placing on said top surfaces;

a securing unit provided at said base member for securing the wiping sheet on said top surfaces of said base member;

an elongated handle rearwardly and inclinedly extended from said rear wall of said base member at a direction aligning with said top ridge for a user to position said base member between the buttocks of said user; and a hinge for detachably attaching said handle to said rear wall of said base member, wherein said hinge contains a plurality of engaging slots which are provided at said rear end of said base member and are formed at different orientations, such that a coupling end of said handle is engaged with one of said engaging slots for enabling said user to angle said base member for optimal contact and comfort.

15. The holder, as recited in claim 14, wherein said hinge contains an enlarged slot portion formed at said rear wall of said base member, wherein one of said engaging slots is vertically, radially, and upwardly extended from said slot portion while two of said engaging slots are inclinedly, radially and upwardly extended from said slot portion, such that when said coupling end of said handle is coupled at said slot portion with one of said engaging slots, said base member is retained at a predetermined orientation.

16. The holder, as recited in claim 14, wherein said coupling end of said handle has a non-circular cross section matching with said engaging slot having a non-circular cross section in such a manner that when said coupling end of said handle is slidably inserted into one of said engaging slots, said coupling end of said handle is interlocked with said base member for preventing an unwanted rotational movement of said base member with respect to said handle.

* * * * *